United States Patent [19]

Quayle

[11] 4,195,419

[45] Apr. 1, 1980

[54] AIR INLET FOR A DISHWASHING APPARATUS

[75] Inventor: Lawrence L. Quayle, Lambs Grove, Iowa

[73] Assignee: The Maytag Company, Newton, Iowa

[21] Appl. No.: 940,029

[22] Filed: Sep. 6, 1978

[51] Int. Cl.[2] ..... B08B 3/04

[52] U.S. Cl. ..... 34/231; 134/102

[58] Field of Search ..... 34/221, 227, 231, 54; 134/94, 102, 183

[56] References Cited

U.S. PATENT DOCUMENTS

| | | | |
|---|---|---|---|
| 2,422,022 | 6/1947 | Koertge | 134/94 |
| 3,026,628 | 3/1962 | Berger et al. | 34/231 |
| 3,378,933 | 4/1968 | Jenkins | 34/54 |
| 3,397,708 | 8/1968 | Braden | 134/57 |
| 3,739,145 | 11/1971 | Woehler | 219/370 |
| 3,908,681 | 9/1975 | Schimke et al. | 34/231 X |

*Primary Examiner*—Edward G. Favors

*Attorney, Agent, or Firm*—Richard L. Ward

[57] ABSTRACT

A dishwashing apparatus has an air inlet conduit located in the bottom wall of the washing chamber. A forced air circulation apparatus is attached to a support bracket on the air inlet conduit from the outside of the washing chamber through a partial turn rotary motion. The air circulation apparatus is locked in this attached position by tightening a threaded fastener from within the washing chamber.

12 Claims, 8 Drawing Figures

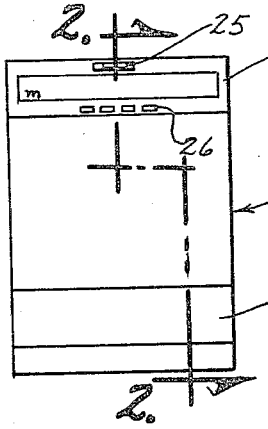
Fig. 1
Fig. 2
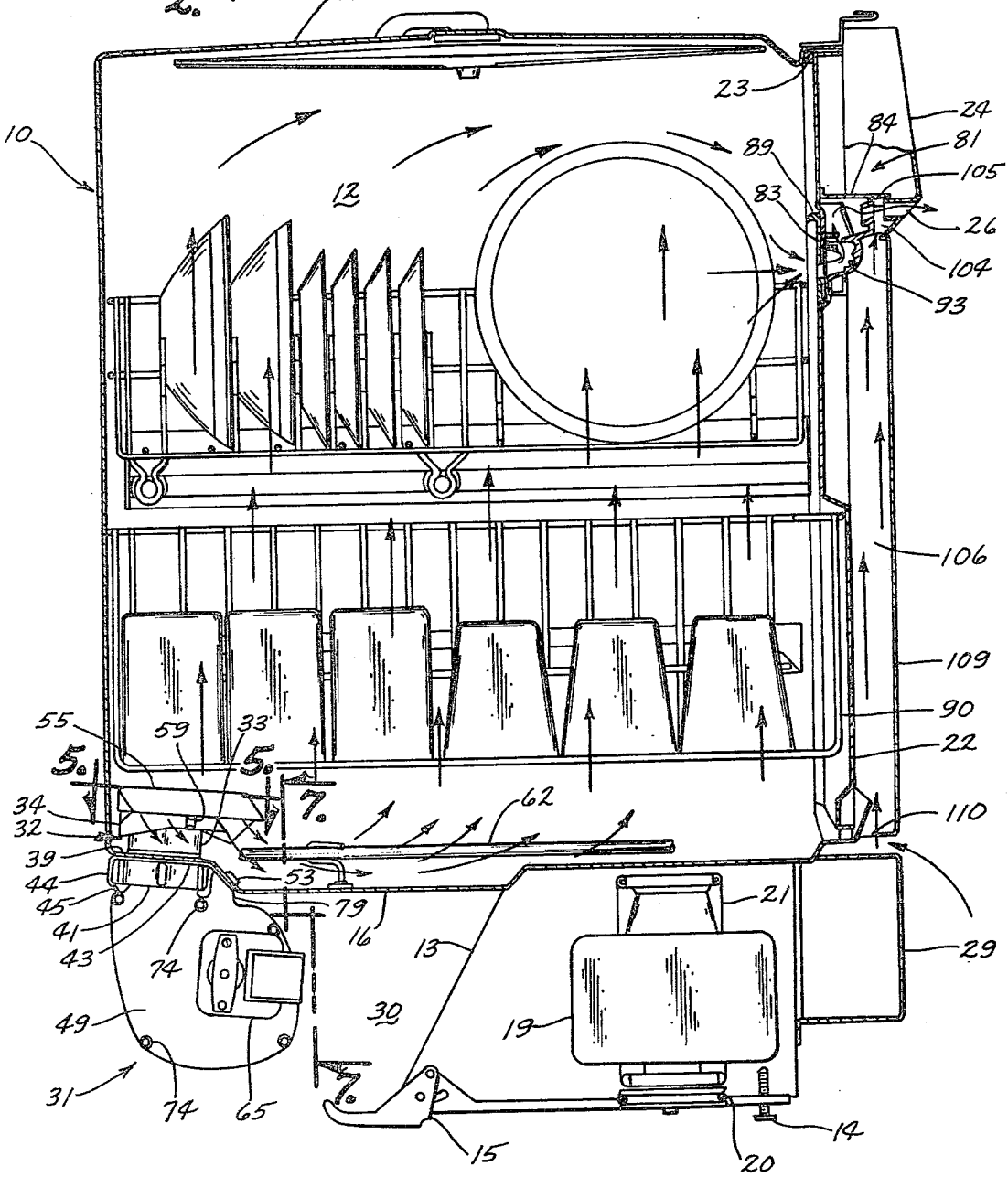

AIR INLET FOR A DISHWASHING APPARATUS

BACKGROUND OF THE INVENTION

Field of the Invention

This invention relates generally to the field of dishwashers and more particularly to an air inlet therefor.

While forced air circulation systems have been employed previously in the dishwasher industry there is a void in the area of systems wherein the blower unit can be easily attached to and detached from the washing chamber. Generally the dishwasher must be removed from the surrounding cabinetry in order to replace or service the blower unit.

Prior art discloses motor driven blower systems operable for forcing heated air into the washing chamber of a dishwasher through one or a plurality of conduits. Also shown in prior art is a system in which the air inlet means includes a gravity closed valve which is opened by airflow.

Also disclosed by prior art is a dishwasher having a heating element in a separate heating chamber at the bottom of the washing chamber with an external blower operable for directing ambient-temperature air into the heating chamber for heating.

While prior art indicates blower apparatus secured to the washing chamber from within the chamber, there is no indication of provisions for removably securing the blower assembly to the air inlet and to the dishwashing apparatus.

SUMMARY OF THE INVENTION

It is an object of the invention to provide an air inlet having air circulation means which is readily attached and detached from the washing chamber.

It is a further object of the instant invention to provide an air circulation means which may be attached to and detached from the washing chamber while the dishwashing apparatus remains in an operational posture.

It is a still further object of the instant invention to provide an air circulation means which can be locked in its operational position from within the washing chamber.

The instant invention achieves these objects in an air inlet system for a dishwashing apparatus including a tub for defining a washing chamber and a component compartment below the chamber. An air inlet assembly forms an airflow path into the chamber and an air circulation assembly is removably supported on the air inlet assembly. Support structure is provided for securing the air circulation assembly and includes a locking member accessible from within the chamber for operatively locking the air circulation assembly to the air inlet assembly and to the apparatus.

Operation and construction of the air inlet system and further objects and advantages thereof will become evident as the description proceeds and from an examination of the accompanying four pages of drawings.

BRIEF DESCRIPTION OF THE DRAWINGS

The drawings illustrate a preferred embodiment of the invention with similar numerals referring to similar parts throughout the several views, wherein:

FIG. 1 is a front view of a dishwashing machine;

FIG. 2 is a vertical sectional view taken generally along lines 2—2 of FIG. 1;

DESCRIPTION OF A PREFERRED EMBODIMENT

Figure 3:
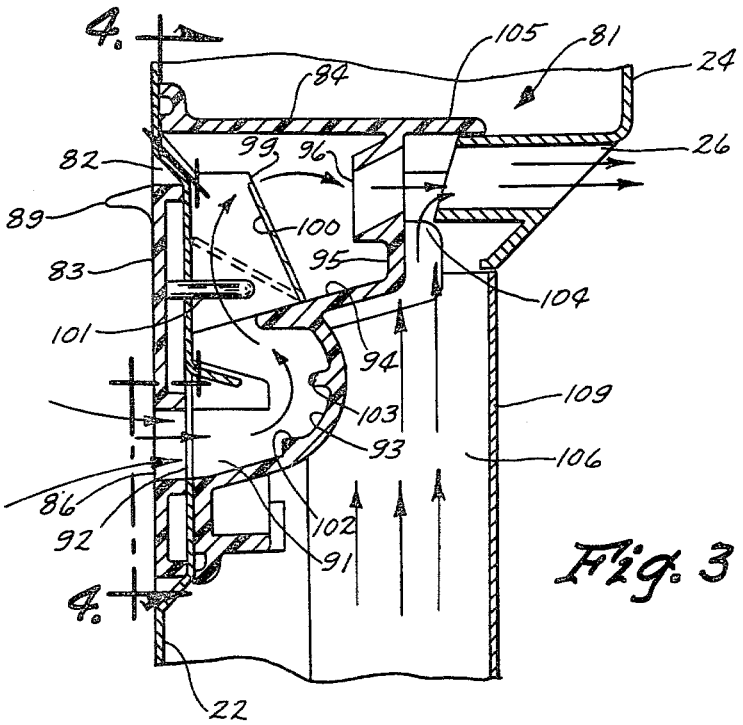
FIG. 3 is an enlarged fragmentary view through the door vent similar to that portion shown in FIG. 2.

Referring to the drawings there is shown in FIG. 1 a dishwashing apparatus 10. As further shown in FIG. 2, the dishwashing apparatus 10 includes a tub 11 forming a washing chamber 12 to which is attached side supports 13 extending downwardly to support the dishwashing apparatus 10 on the floor of an appropriate enclosure.

As shown in FIG. 2, the dishwashing apparatus 10 is supported on a plurality of floor-engaging members including a pair of screw-in feet 14 at the front of the machine which are easily adjustable from the front of the machine and also including a pair of pivotally mounted feet 15 at the rear of the side supports 13. The pivoted feet 15 are also adjustable from the front of the machine. This adjustable foot mechanism 15 is more particularly disclosed and claimed in U.S. Pat. No. 3,750,989 issued Aug. 7, 1973 to Richard P. Bergeson and assigned to the assignee of the instant invention.

The tub 11 or washing chamber 12 has a bottom wall 16 which includes a generally central recess and opening in which is positioned a combination sump and pump assembly (not shown) including a recirculating pump operable for effecting a recirculation of washing liquid in the washing chamber 12 and a drain pump for removing washing liquid from the washing chamber 12. The combination sump and pump assembly is connected to a drive motor 19 through a round stretch belt 20 as generally shown in FIG. 2. The drive motor 19 is resiliently mounted to a side support 13 through a mounting bracket 21 as also shown in FIG. 2. The pump and sump assembly and its connection to the drive motor 19 is more particularly disclosed and claimed in U.S. Pat. No. 3,963,046 issued June 15, 1976 to Richard P. Bergeson and assigned to the assignee of the instant invention.

An access door 22 is provided at the front of the dishwashing apparatus 10 which is operable between an open position and a closed position to provide access to the interior of the washing chamber 12 for loading and unloading dishes and other utensils. A gasket 23 or other suitable seal means is provided around substantially all of the periphery of the access door 22 to prevent washing liquid from being discharged onto the floor area adjacent the dishwashing apparatus 10.

The upper portion of the access door 22 mounts a control panel 24 for housing various switches and a timer or sequential control means (not shown). A door latching device 25 is also mounted within the control panel 24 and serves to lock the access door 22 in a closed position when the pump is in operation. The control panel 24 further includes a plurality of tunnel shaped openings 26 as in FIG. 3 to provide a vent path for the escape of hot-moist air from the washing chamber 12 during the dry portion of a cycle of operations and as will be more fully described hereinafter.

FIGS. 1 and 2 show an access cover 29 below the access door 22 which is removable from the front of the dishwashing apparatus 10. Removal of the access cover 29 provides access to a component compartment 30 as shown in FIG. 2 and allows the drive motor 19, blower assembly 31 and various other components to be serviced from the front of the dishwashing apparatus 10.

When viewed from the front of the dishwashing apparatus 10, as in FIG. 1, the air inlet 32 is located in the right hand rear corner of the tub 11 or washing chamber 12. FIGS. 2 and 5-8 show the assembly of the air inlet 32 and its associated mechanism to the washing chamber 12.

Figure 5:
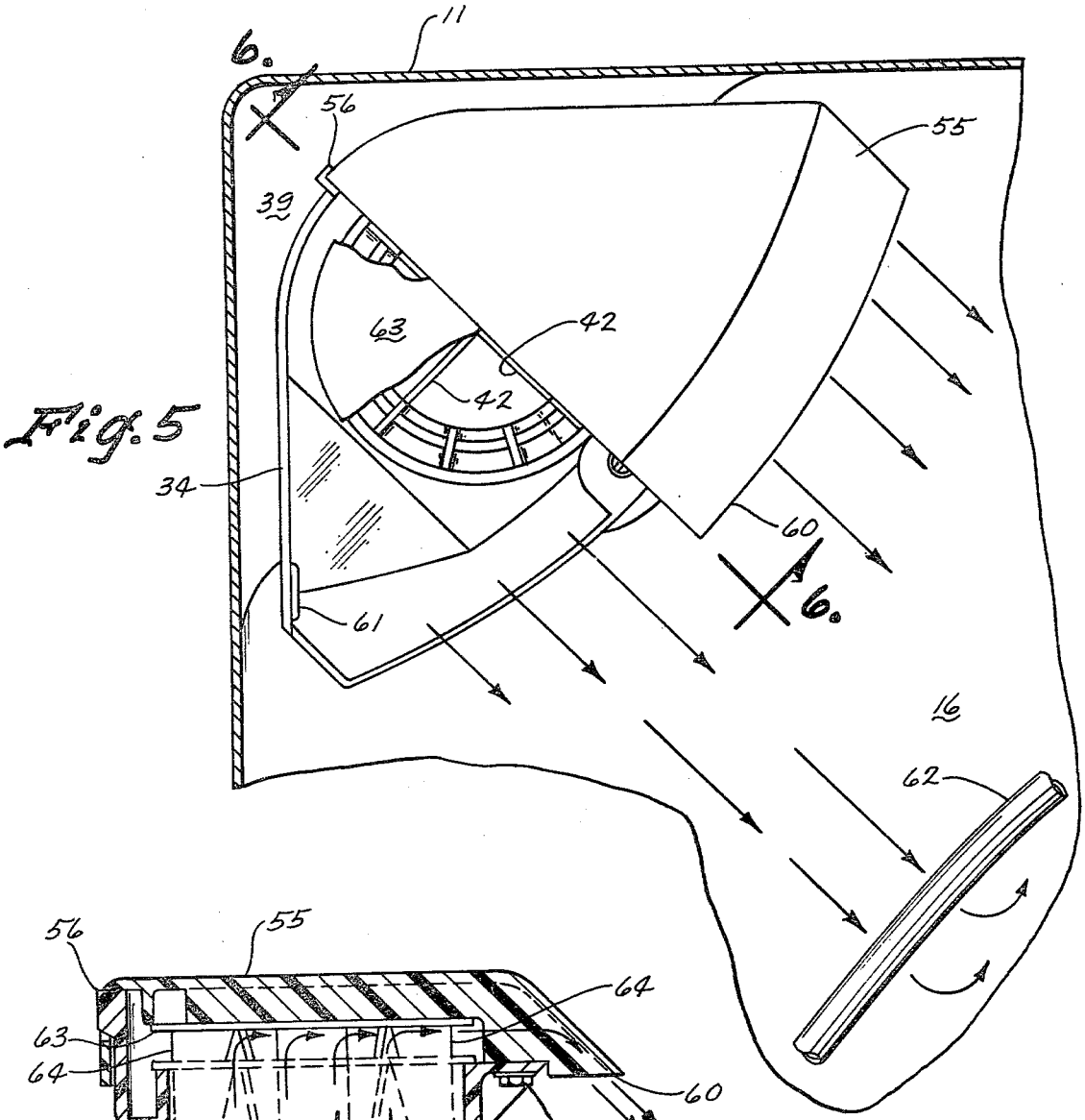
FIG. 5 is a sectional view of the air inlet taken generally along lines 5—5 of FIG. 2.
Figure 6:
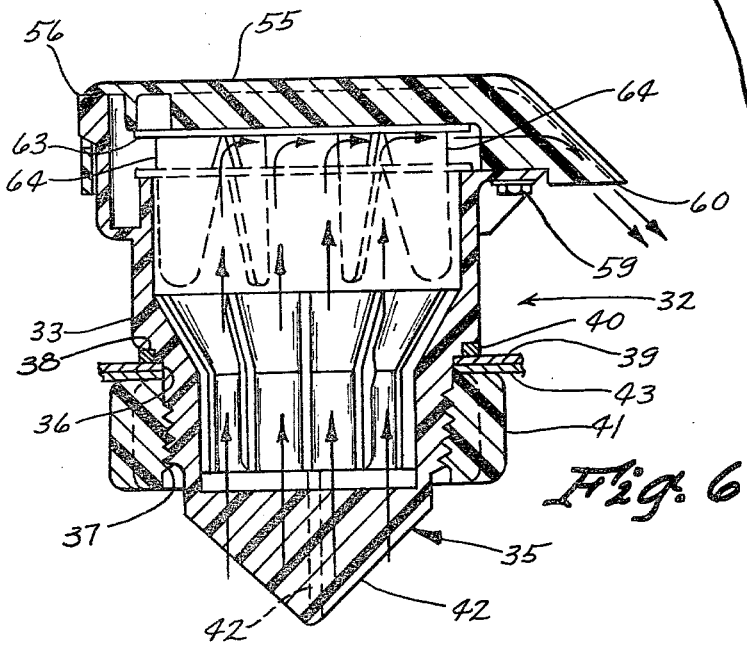
FIG. 6 is a sectional view taken generally along lines 6—6 of FIG. 5.

The air inlet 32, as best shown in FIGS. 5 and 6, is comprised of a molded thermoplastic member which includes an inlet housing defining a conduit 33. This conduit 33 further includes a guide portion 35 at one end and a flared air spreader or diffuser portion 34 at the opposite end.

The conduit 33 end which includes the guide portion 35 is smaller in diameter than the remainder of the conduit 33. This portion of the conduit 33 has molded threads 37 spaced from the guide portion 35 and a support shoulder 38 for seating and retaining a gasket 40 on the conduit 33.

The air inlet 32 is secured to an elevated surface 39 of the bottom wall 16 of the washing chamber 12 from within the chamber 12 by inserting the guide end 35 of the conduit 33 through the mounting hole 36. The guide portion 35 of the conduit 33 thus extends into the component compartment 30 of the dishwashing apparatus 10 and a thermoplastic nut 41 is hand tightened onto the conduit 33 to secure the air inlet 32 to the washing chamber 12 and to seal the gasket 40 to the bottom wall 16.

Figure 8:
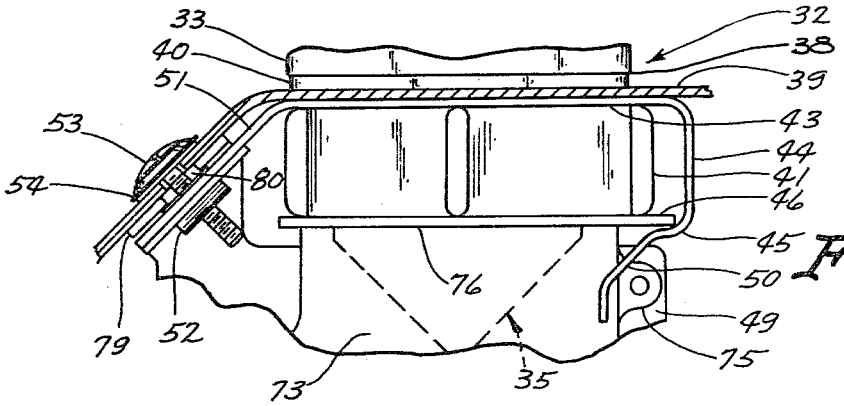
FIG. 8 is a fragmentary view taken along lines 8—8 of FIG. 7.

The guide portion 35 of the conduit 33 is made up of two intersecting rib sections 42 which depend from the conduit 33 and which form downwardly extending triangular members as shown in FIGS. 5, 6 and 8. The guide portion 35 is operable for guiding and aligning the blower assembly 31 with the axis of the air inlet 32.

The flared portion 34 of the conduit 33 is located within the washing chamber 12 as shown in FIGS. 5 and 6. The conduit 33 flares out in an opened fan-like shape and functions as an air diffuser or spreader to distribute incoming air within the washing chamber 12.

Figure 7:
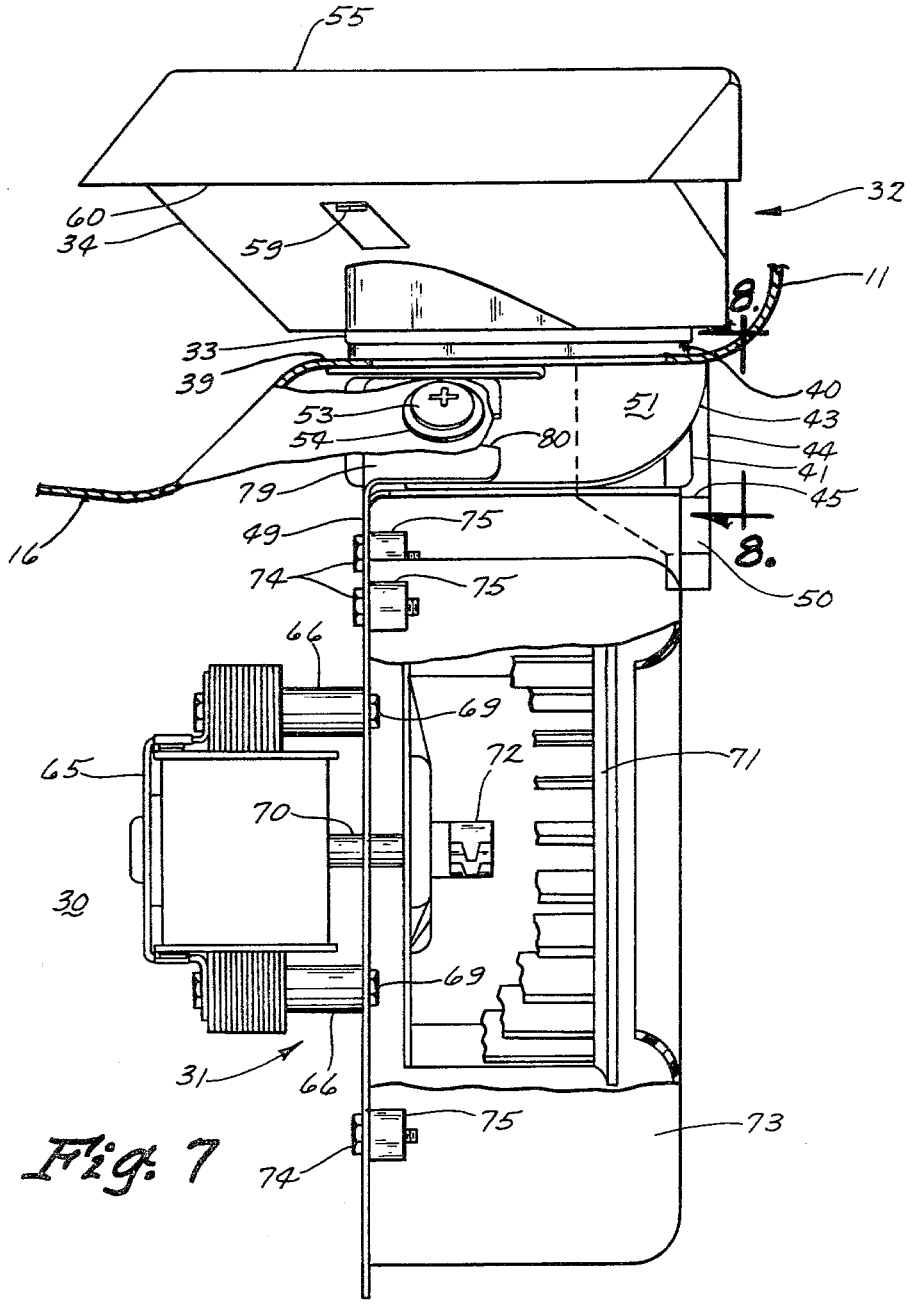
FIG. 7 is a fragmentary section view of the air inlet and blower taken generally along lines 7—7 of FIG. 2.

As shown in FIGS. 7 and 8, a sheet metal blower support bracket 43 having an annular ring which slips over the threaded portion 37 of the conduit 33 is captured between the plastic nut 41 and the outside surface of the bottom wall 16 of the washing chamber 12. This bracket 43 includes a downwardly projecting leg 44 which has an inwardly protruding tab 45, as shown in FIG. 8, for engaging with an ear portion 46 of the blower bracket 49 to partially support the blower assembly 31 which will be discussed in further detail herein. Extending angularly downward from the tab 45 is a guide 50 which engages with the ear portion 46 of the blower bracket 49 during assembly to insure that the ear portion 46 properly contacts and is supported by the tab 45 as shown in FIG. 8. The blower support bracket 43 also includes an angularly downwardly projecting tab 51 as shown in FIGS. 7 and 8 which mounts a spring clip type threaded fastener 52. The fastener 52 is located to receive a machine screw 53 from inside the washing chamber 12. A seal washer arrangement 54 is located under the head of the screw 53 to prevent leakage of washing liquid from the washing chamber 12.

A fan-shaped thermoplastic diffuser cap 55 matches the flared fan-shaped portion 34 of the conduit 33 and as shown in FIG. 6 is secured to the flared portion 34 of the conduit 33 by a molded slot and tab arrangement 56 on one side and by a thread forming screw 59 on the other side. The diffuser cap 55 has a downwardly extending frontal lip 60 which hinders washing liquid from entering the conduit 33. The extremities of the flared portion 34 extend downwardly toward drain slots 61 in the outer edges of the fan as shown in FIG. 5. If washing liquid should gain access to the fan-shaped portion 34 of the conduit 33 it will be drained back into the washing chamber 12 by the drain slots 61 in the extremities of the flared portion 34 of the conduit 33. The frontal lip 60 of the diffuser cap 55 directs ambient-temperature air downwardly and outwardly toward a circular calrod heater 62 secured to the bottom wall 16 of the washing chamber 12.

As further shown in FIGS. 5 and 6 a disk-shaped air valve or baffle 63 is located at the egress of the conduit 33 directly subjacent the diffuser cap 55. This air valve 63 is molded of a thermoplastic material and has a plurality of downwardly projecting legs 64 which form a diameter slightly smaller than the inner diameter of the conduit 33. These legs 64 serve to maintain the air valve 63 generally centered on the inner diameter of the conduit 33. The air valve 63 is normally in the closed posture as indicated by the dashed lines in FIG. 6 but is moved to and maintained in the full line open posture by airflow into the washing chamber 12. The air valve 63 in the conduit 33 in this particular embodiment of the invention prevents the escape of suds and foam from the washing chamber 12 during the washing portion of a cycle of operations.

The air circulation means or blower assembly 31 is best shown in FIGS. 2 and 7. The blower assembly 31 is mounted to the conduit 33 from beneath the tub 11 or washing chamber 12 through the support bracket 43. The blower assembly 31 is secured in the mounted position by the machine screw 53 and seal 54 arrangement shown in FIGS. 7 and 8 is thus effectively clamped to and supported by the tub 11 through the support bracket 43.

The blower assembly 31 includes a sheet metal blower bracket 49 which serves as a mounting plate for the various components of the blower assembly 31. A fractional horsepower electric motor 65 is secured to one side of the blower bracket 49 as best shown in FIG. 7 through a pair of stand-off posts 66 and threaded fasteners 69. The motor shaft 70 protrudes through to the opposite side of the blower bracket 49 and a plastic blower wheel 71 is pushed onto the shaft and secured thereon by a spring clip 72.

After the motor 65 and blower wheel 71 have been assembled to the blower bracket 49, a thermoplastic blower housing 73, having the proper scroll shape, is secured to the bracket 49 as shown in FIG. 7 by a plurality of thread forming fasteners 74 which are threaded into pilot holes in the bosses 75 molded into the housing 73.

As FIGS. 7 and 8 show, the upper portion of the blower bracket 49 is formed at a right angle to the bracket 49 and extends over the thermoplastic blower housing 73. The formed portion 76 of the bracket 49 includes an ear portion 46 which is supported on the tab 45 of the blower support bracket 43 as best shown in FIG. 8.

The upper portion of the blower bracket 49 further includes a tab 79 which is shaped to conform angularly to the configuration of the elevated surface 39 of the bottom wall 16 of the washing chamber 12. This tab 79 has a generally V-shaped notch 80 for receiving the threaded portion of the machine screw 53 and seal 54 arrangement extending from inside the washing chamber 12.

When the dishwashing apparatus 10 has been installed in a home, access to the component compartment 30 for service is from the front of the apparatus 10 by removal of the access cover 29. The blower assembly 31 is mounted in the operational position as shown in FIGS. 2 and 7 as follows: The access cover 29 is removed for accessibility to the component compartment 30 from the front of the dishwasher 10. The blower assembly 31 is moved into vertical alignment and centered on the air inlet 32 from the front of the dishwasher 10 by mating the blower assembly 31 with the locator member or guide means 35 on the bottom of the conduit 33 as shown in FIG. 6 and in dashed lines in FIG. 8. The blower assembly 31 is then rotated counterclockwise approximately ⅛ turn to align the blower bracket ear 46 with the inwardly protruding tab 45 of the blower support bracket 43. This ⅛ turn also moves the V-shaped notch 80 of the blower bracket tab 79 into position directly above the blower support bracket tab 51 and its spring type threaded fastener 52. The V-shaped notch 80 encompasses the machine screw 53 which extends into the threaded fastener 52 from within the washing chamber 12 as shown in FIG. 8. The machine screw 53 is tightened from within the washing chamber 12 to secure the blower assembly 31 in the operational posture of FIG. 7 by clamping the blower bracket tab 79 between the washing chamber 12 outer wall and the blower support bracket tab 51 to effectively support the blower assembly 31 from the tub 11. Through this ⅛ turn mounting of the blower assembly 31 to the air inlet 34, the unit can be readily serviced from the front of the dishwashing apparatus 10 without removing the dishwashing apparatus 10 from the cabinetry.

Figure 4:
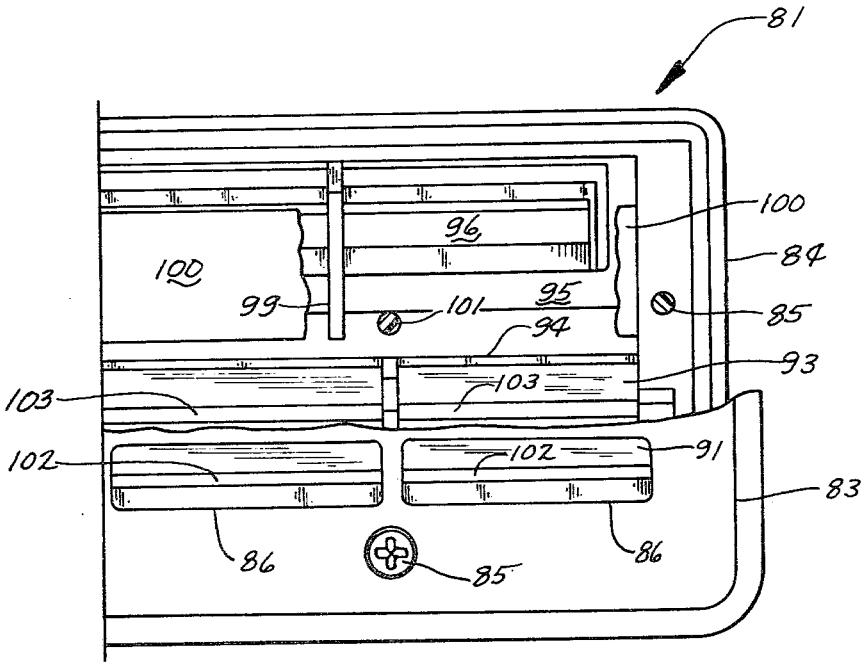
FIG. 4 is a fragmentary sectional view of the door vent taken generally along lines 4—4 of FIG. 3.

As shown in FIGS. 2, 3 and 4 the access door 22 includes a vent-air outlet system 81 mounted in its upper section which is operable for exhausting hot-moist air from the washing chamber 12 during a drying portion of a predetermined cycle of operations. The vent 81 is generally centered on the width of the access door 22 and, as shown in FIG. 3, a depression 82 is formed in the access door 22 so that the cover portion 83 of the vent 81 located inside the washing chamber 12 is substantially flush with the interior surface of the access door 22.

FIG. 4 shows the right one-half of the vent-air outlet system 81 from inside the washing chamber 12 with the vent system 81 being symmetrical about the center line. The vent duct housing 84 is secured to the access door 22 by a plurality of thread forming fasteners 85 which extend through the cover 83 on the inside of the access door 22, through clearance holes in the access door 22 and thread into the vent duct housing 84 on the outside of the access door 22.

The cover 83 is molded of a thermoplastic material and is generally rectangular in shape. The lower portion of the cover 83 includes a plurality of rectangular slots 86 for venting hot-moist air from the washing chamber 12. The cover 83 also includes, at its extreme upper center section, a lug 89 protruding into the washing chamber 12. When the access door 22 is in the opened position for loading or unloading dishes, the lower basket 90 can be pulled out onto the access door 22 to facilitate loading or unloading. The lug 89 on the cover 83 is radiused to engage with a section of the basket 90 and stop outward movement of the basket 90 to keep the operator from pulling the basket 90 onto the floor.

As previously mentioned, the vent duct housing 84 is molded of a thermoplastic material and is located on the outside of the access door 22. The vent duct housing 84 is also substantially rectangular in shape. The lower portion of the vent duct housing 84 has a lengthwise opening 91 which juxtaposes the plurality of rectangular slots 86 in the cover 83 and a passageway 92 in the access door 22. This vent duct opening 91 extends forward, toward the exterior of the dishwashing apparatus 10, through an upwardly curving arcuate portion 93 as best shown in FIG. 3.

A pair of horizontal rib sections 102 and 103 extend across the vent on the face of the upwardly curving arcuate portion 93 and serve to reduce jets of washing liquid, which may enter the vent duct housing 84 through the cover slots 86, into droplets of washing liquid. This reduction action prevents a jet of washing liquid from following the upwardly curving arcuate portion 93 and possibly escaping from the washing chamber 12. The sloping surfaces of this section also tend to drain washing liquid back into the washing chamber 12.

Located directly above the arcuate portion 93 is a ledge or landing 94 which extends generally upwardly and outwardly as shown in FIG. 3 and terminates at a vertical wall section 95. This vertical wall section 95 has a rectangular slot or opening 96 extending substantially the full width of the vent duct 84 for exhausting hot-moist airflow from the washing chamber 12. The vent duct opening 91 and the slot or opening 96 are located in parallel but vertically spaced apart planes in said vent duct housing 84. A serpentine, water-excluding S-shaped airflow path is thus defined as generally indicated by the arrows in FIG. 3.

A pair of substantially vertical ribs 99 extend upwardly from the ledge or landing 94 and serve as stops for a flapper valve mechanism 100 in the vent duct housing 84. A rectangular flapper valve 100 made of thermoplastic, fiberboard or aluminum material is inserted in the vent duct housing 84 as shown in FIGS. 3 and 4. The flapper valve 100 is pivoted from the dashed line position to the full position of FIG. 3 about the base of the vertical ribs 99. FIG. 3 also shows one of a pair of pins 101 which are molded to the back side of the vent cover 83 and protrude into the vent duct housing 84. These pins 101 retain the lower portion of the flapper valve 100 in close proximity to the base of the vertical ribs 99.

When the flapper valve 100 is closed by gravity against the access door 22, as shown in dashed lines in FIG. 3, natural airflow through the vent duct 22 is precluded. The flapper valve 100 will be opened to the full line position of FIG. 3 by forced airflow through the dishwashing apparatus 10 when the blower 31 is operated during the dry portion of a predetermined cycle of operations. Gravitational return of the flapper valve 100 to the closed dashed line position of FIG. 3 when blower 31 operation is terminated is assured by the slightly over center position of the top of the flapper valve 100 when opened against the ribs 99. At other times the washing chamber 12 will be essentially sealed to the escape of hot-moist air except for small amounts around the periphery of the flapper valve 100, through the water inlet opening (not shown) and through a small gap between the ends of the access door gasket 23.

As FIGS. 2 and 3 show, the control panel openings 26 are tunnel shaped and extend inwardly to a position directly adjacent the exhaust slot 96 in the vent duct housing 84 with approximately a ¼ inch gap 104 between the slot or opening 96 and panel openings 26. A hood 105 projects beyond the vent duct slot 96 and covers the upper portion of the control panel tunnel openings 26. Ambient temperature air enters the space 106 between the access door 22 and the door panel 109 through the opening 110 at the bottom of the door panel 109 and rises between the access door 22 and the door panel 109 through natural convection. When the blower 31 is forcing hot-moist air from the washing chamber 12 during dry, the ambient temperature air enters the ¼ inch air gap 104 at the lower portion of said openings 26 and mixes with the hot-moist air exhausting from the washing chamber 12 to help prevent condensation of moisture on the control panel 24 exterior surfaces. The hood 105 covering the control panel openings 26 lies directly upon the top surface of the tunnel openings 26 and prevents either ambient or hot-moist air from flowing into the upper portion of the interior of the control panel 24.

The feature of an airflow drying system is also disclosed and is claimed in a copending application entitled "Dishwasher Airflow Drying System" filed on an even date with this application by Lawrence L. Quayle and assigned to the assignee of the instant invention.

In operation, during the "washing and rinsing" portion of the cycle of operations, sufficient air will escape around the periphery of the flapper valve 100 and at the water inlet to preclude the actual opening of the flapper valve 100 prior to the "dry" portion of the cycle. Opening the access door 22 during the "washing " portion of the cycle of operations to insert an additional item to be washed permits the washing chamber 12 to fill with relatively cool ambient-temperature air which rapidly expands. Closing the access door 22 confines the air and causes it to try to escape through all openings. The flapper valve 100 in the present construction provides a means of escape for this expanding air. The air pressure will open the flapper valve 100 to relieve the pressure and the flapper valve 100 will gravitationally close after the pressure has been relieved.

When the timer or sequential control means has advanced to the "dry" portion of a cycle of operations, the blower motor 65 will be energized. The blower motor 65 will turn the blower wheel 71 which will force ambient temperature air through the conduit 33 to open the disk-shaped air valve or baffle 63 to the full line position of FIG. 6. The ambient temperature air will be directed by the diffuser cap 55 in a downward and outward direction as shown in FIGS. 2, 5 and 6 toward the calrod heater 62 on the bottom wall 16 of the washing chamber 12. When the ambient temperature air is forced over the calrod heater 62, it picks up heat and rises upwardly through the dishes loaded in the baskets. After flowing through and around the dishes and evaporating moisture therefrom, the now hot-moist air is exhausted through the vent-air outlet system 81. The blower 31 forces the hot-moist air through the slots 86 in the vent cover 83 and through the vent duct opening 91. The air follows the serpentine path of FIG. 3 and forces the flapper valve 100 to the full line open position of FIG. 3. The air exits the vent system 81 through the vent duct exhaust opening 96 where it crosses the air gap 104 and is mixed with ambient temperature air rising between the access door 22 and the door panel 109 and finally passes through the control panel openings 26 to atmosphere. Upon termination of the blower motor 65 operation, the air valve 63 in the inlet conduit 33 and the flapper valve 100 in the vent-air oulet 81 will be gravitationally closed. It is also anticipated that the described airflow system could be used without energization of the calrod heater 62 to provide an energy saving dry.

The present construction thus provides an improved air inlet system for a dishwashing apparatus 10. The system includes a blower assembly 31 which may be attached or detached from the washing chamber 12 without removing the dishwashing apparatus 10 from the kitchen cabinetry. The blower assembly 31 is locked in the attached position from within the washing chamber 12.

In the drawings and specification, there has been set forth a preferred embodiment of the invention and although specific terms are employed these are used in a generic and descriptive sense only and not for purposes of limitation. Changes in the form and the proportion of parts as well as the substitution of equivalents are contemplated as circumstances may suggest or render expedient without departing from the spirit or scope of the invention as is further defined in the following claims.

I claim:

1. An air inlet system for a dishwashing apparatus having means including a tub for defining a washing chamber and a component compartment below said chamber, the combination comprising: an air inlet assembly forming an airflow path into said chamber; an air circulation means removably supported on said air inlet assembly; and support structure including overlapping bracket means on said air inlet assembly and said air circulation means for supporting said air circulation means, said support structure further including means accessible from within said chamber for operatively locking said air circulation means to said air inlet assembly and to said apparatus.

2. An air inlet system as defined in claim 1 wherein said means for locking includes a threaded fastener extending into said support structure from within said chamber and cooperable with said support structure for retaining said air circulation means to said air inlet assembly and to said apparatus.

3. An air inlet system as defined in claim 1 wherein said bracket means are engageable upon a partial turn movement therebetween and wherein said means accessible within said chamber is operable for locking the connection whereby said air circulation means is effectively supported by said tub through said support structure and said means for locking.

4. An air inlet system for a dishwashing apparatus having means including a tub defining a front-opening dishwashing chamber and a front-opening component compartment below said chamber, the combination comprising: an air inlet conduit forming an airflow path into said chamber; an air circulation means disposed in said compartment in communication with said air inlet conduit for introducing air into said chamber and accessible for assembly and disassembly from the front of said dishwashing apparatus through a partial turn rotary movement; support structure engageable with said air circulation means for removably supporting said air circulation means on said apparatus; and fastener means accessible from within said chamber for locking said air circulation means to said apparatus through said support structure.

5. An air inlet system as defined in claim 4 wherein said air inlet conduit further includes guide means on that portion of said conduit extending through to said compartment for guiding and aligning said air circulation means with the axis of said air inlet conduit.

6. An air inlet system as defined in claim 4 wherein said support structure includes a bracket engageable with said air circulation means and cooperable with said fastener means for locking said air circulation means to said apparatus.

7. An air inlet system for a front-opening dishwashing apparatus including a tub having a bottom wall and defining a washing chamber for use in washing and drying dishes and further including means defining a front-opening component compartment below said chamber, the combination comprising: an air inlet conduit for establishing an airflow path into said chamber; motor driven forced air circulation means disposed in said compartment and cooperable with said conduit for forcing ambient-temperature airflow into said chamber when drying said dishes and removably mounted to said bottom wall from the front through a partial turn rotary movement of said forced air circulation means; guide means on that portion of said conduit extending into said compartment, said guide means being operable for facilitating alignment of said forced air circulation means with the axis of said conduit during said mounting; a support bracket associated with said conduit and said bottom wall for engaging with and supporting said forced air circulation means on said tub; and locking means cooperable with said support bracket for locking said forced air circulation means to said tub from within said chamber.

8. An air inlet system as defined in claim 7 wherein said locking means includes a threaded member extending through said bottom wall of said tub and into said support bracket for clamping said forced air circulation means between said bottom wall and said support bracket to effectively support said forced air circulation means on said tub.

9. An air inlet system as defined in claim 8 wherein said forced air circulation means includes a bracket having a notched tab for engaging with said threaded member to accomplish said clamping.

10. An air inlet system for a dishwashing apparatus having means including a tub for defining a washing chamber and a compartment below said chamber with said tub having a bottom wall defining an opening to receive air inlet means, the combination comprising: an air inlet housing extending from said chamber through said bottom wall opening into said compartment and defining an airflow path into said chamber, said housing including an intermediate outer support shoulder disposed within said chamber adjacent said bottom wall and further including a portion depending into said compartment; holding means engageable with said depending portion and cooperable with said support shoulder for attaching said inlet housing to said bottom wall; a support bracket assembled on said depending portion and including an annular ring portion retained between said bottom wall and said holding means and further including a downwardly projecting leg portion; an air circulation assembly supported on said leg portion for communication with said airflow path and operable for effecting an airflow into said chamber; diffuser means in said chamber on said inlet housing for directing and spreading said airflow; and locking means adjacent said diffuser means for access in said chamber and extending through said bottom wall for engagement with said support bracket to operatively lock said air circulation assembly to said apparatus.

11. An air inlet system for a dishwashing apparatus as in claim 10 wherein said depending portion of the inlet housing includes a guide portion to facilitate axial alignment of the air circulation assembly with said housing and wherein said leg portion includes means to receive said air circulation assembly through an axial and partial turn rotary motion.

12. An air inlet system for a dishwashing apparatus as in claim 10 and further including a normally closed valve associated with said inlet housing for closing said airflow path.

* * * * *